US008851656B2

(12) United States Patent
Akamine

(10) Patent No.: US 8,851,656 B2
(45) Date of Patent: Oct. 7, 2014

(54) IMAGE FIXATION APPARATUS AND RECORDING APPARATUS

(75) Inventor: Masahiro Akamine, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 120 days.

(21) Appl. No.: 13/605,564

(22) Filed: Sep. 6, 2012

(65) Prior Publication Data

US 2013/0063534 A1 Mar. 14, 2013

(30) Foreign Application Priority Data

Sep. 9, 2011 (JP) ..... 2011-196894

(51) Int. Cl.
*B41J 2/01* (2006.01)
*B41J 11/00* (2006.01)

(52) U.S. Cl.
CPC ..... *B41J 11/002* (2013.01)
USPC ..... 347/102; 347/101

(58) Field of Classification Search
None
See application file for complete search history.

(56) References Cited

U.S. PATENT DOCUMENTS

2005/0151815 A1 7/2005 Kanai et al.
2011/0050823 A1* 3/2011 Toya et al. ..... 347/102

FOREIGN PATENT DOCUMENTS

| | | |
|---|---|---|
| JP | 03-227631 | 10/1991 |
| JP | 3-057701 | 7/2000 |
| JP | 2001-212949 | 8/2001 |
| JP | 2004-050546 | 2/2004 |
| JP | 4429923 | 3/2010 |
| JP | 2010-208107 | 9/2010 |
| WO | 2004/094150 | 11/2004 |

* cited by examiner

*Primary Examiner* — Geoffrey Mruk
(74) *Attorney, Agent, or Firm* — Workman Nydegger

(57) ABSTRACT

An image fixation apparatus includes a supporting surface that is a part of a path along which a recording target medium is transported from an upstream side to a downstream side and can support the recording target medium; and an image fixation section that is provided opposite the supporting surface and performs image fixation processing when the recording target medium is supported by the supporting surface after recording of an image on the recording target medium at a position upstream of the supporting surface, the image fixation processing being processing of fixing the image on the recording target medium, wherein, when measured in a direction in which the supporting surface and the image fixation section are provided opposite to each other, the supporting surface is relatively distant from the image fixation section as compared with a region that is located upstream of the supporting surface in the transportation path.

8 Claims, 5 Drawing Sheets

IMAGE FIXATION APPARATUS AND RECORDING APPARATUS

BACKGROUND

1. Technical Field

This application claims priority to Japanese Patent Application No. 2011-196894 filed on Sep. 9, 2011. The entire disclosure of Japanese Patent Application No. 2011-196894 is hereby incorporated herein by reference.

The present invention relates to a recording apparatus such as, for example, an ink-jet printer and to an image fixation apparatus that is provided in the recording apparatus and is used for fixing an image on paper, etc., on which the image has been recorded.

2. Related Art

In general, an ink-jet printer is widely known as a recording apparatus that records an image on a recording target medium. An ink-jet printer ejects ink from its recording head (recording section) toward paper (recording target medium) to perform printing. In such a printer, typically, heat is applied to paper after printing to dry it. As a result of heat drying, an image becomes fixed on the paper.

As a printer that applies heat to paper after printing to dry it, an apparatus that is disclosed in JP-A-2001-212949 is known in the art. In the printer disclosed in JP-A-2001-212949, a pair of heaters (image fixation section) is provided opposite each other with a paper transportation path extending therebetween. The pair of heaters applies heat to paper after printing to dry it.

However, if the paper tends to curl, for example, if it is a roll sheet, there is a risk that the curled part of the paper will contact with each of the two heaters. For this reason, in the printer disclosed in JP-A-2001-212949, if the paper tends to curl, each of the two heaters is moved in such a way as to lengthen the distance between the two heaters in anticipation of the curling of the paper, thereby avoiding the contact of each of the two heaters and the paper.

In the printer disclosed in JP-A-2001-212949, though it is possible to avoid the contact of the paper with each of the two heaters even in a case where the curling of the paper occurs, there is a problem of greater structural complexity because it is necessary to provide a heater movement mechanism for adjusting the distance between the two heaters.

SUMMARY

An advantage of some aspects of the invention is to provide an image fixation apparatus and a recording apparatus that make it possible to avoid the contact of a recording target medium and an image fixation section with a simple structure when the curling of the recording target medium occurs.

An image fixation apparatus according to an aspect of the invention includes: a supporting surface that is a part of a path along which a recording target medium is transported from an upstream side to a downstream side, the supporting surface being able to support the recording target medium; and an image fixation section that is provided opposite the supporting surface and performs image fixation processing when the recording target medium is supported by the supporting surface after recording of an image on the recording target medium at a position upstream of the supporting surface, the image fixation processing being processing of fixing the image on the recording target medium, wherein, when measured in a direction in which the supporting surface and the image fixation section are provided opposite to each other, the supporting surface is relatively distant from the image fixation section as compared with a region that is located upstream of the supporting surface in the path along which the recording target medium is transported.

With this invention, even when a part of the recording target medium on the surface of which an image has now been formed at a position upstream of the supporting surface is raised because of a curl, it is possible to offset this rise of the curled part of the recording target medium by utilizing the difference between the distance from the image fixation section to the region located upstream of the supporting surface in the path along which the recording target medium is transported and the distance from the image fixation section to the supporting surface. Thus, it is possible to avoid the contact of the recording target medium and the image fixation section with a simple structure when the curling of the recording target medium occurs.

In the image fixation apparatus according to an aspect of the invention, it is preferred that the supporting surface include a distance-increasing inclined surface that slopes in such a way as to go away from the image fixation section so that a distance measured from the image fixation section in the direction in which the supporting surface and the image fixation section are provided opposite to each other will increase gradually toward the downstream side of the path along which the recording target medium is transported.

With this invention, even when a part of the recording target medium on the surface of which an image has now been formed at a position upstream of the supporting surface is raised because of a curl, the recording target medium goes away from the image fixation section gradually as it goes down the slope of the distance-increasing inclined surface. Thus, it is possible to smoothly transport the recording target medium along the supporting surface without any contact with the image fixation section.

In the image fixation apparatus according to an aspect of the invention, it is preferred that the supporting surface include a distance-decreasing inclined surface that slopes in such a way as to come closer to the image fixation section so that a distance measured from the image fixation section in the direction in which the supporting surface and the image fixation section are provided opposite to each other will decrease gradually toward the downstream side of the path along which the recording target medium is transported; and the distance-decreasing inclined surface should preferably be located downstream of the distance-increasing inclined surface in the path along which the recording target medium is transported.

With this invention, the distance-decreasing inclined surface reduces the degree of the inclination of the recording target medium with respect to the image fixation section by the distance-increasing inclined surface. By this means, it is possible to avoid the lack of uniformity in image fixation processing applied to the recording target medium by the image fixation section.

In the image fixation apparatus according to an aspect of the invention, it is preferred that the distance-decreasing inclined surface be continuous from the distance-increasing inclined surface at a downstream end of the distance-increasing inclined surface and an upstream end of the distance-decreasing inclined surface; and a junction where the downstream end of the distance-increasing inclined surface and the upstream end of the distance-decreasing inclined surface are formed should preferably correspond to the center of the image fixation section as viewed in a direction in which the recording target medium is transported.

With this invention, since the distance between the image fixation section and the recording target medium is balanced well, it is possible to effectively prevent the contact of the recording target medium and the image fixation section.

In the image fixation apparatus according to an aspect of the invention, it is preferred that a distance from the image fixation section to the upstream end of the distance-increasing inclined surface in the direction in which the supporting surface and the image fixation section are provided opposite to each other be equal to a distance from the image fixation section to the downstream end of the distance-decreasing inclined surface in the direction in which the supporting surface and the image fixation section are provided opposite to each other.

For example, if the recording target medium is elongated paper unreeled from a roll, a restorative force acts in the direction of returning into its original form, that is, the roll. In such a case, especially the leading-edge part of the recording target medium tends to curl. In this respect, with this invention, after the passing of the leading-edge part of the recording target medium over the supporting surface, the recording target medium is stretched taut in parallel to the image fixation section while being supported at the upstream end of the distance-increasing inclined surface and the downstream end of the distance-decreasing inclined surface. Thus, it is possible to perform image fixation processing uniformly on the recording target medium by means of the image fixation section.

In the image fixation apparatus according to an aspect of the invention, it is preferred that an angle of inclination of the distance-increasing inclined surface with respect to the region located upstream of the supporting surface in the path along which the recording target medium is transported be greater than an angle of inclination of the distance-decreasing inclined surface with respect to the region located upstream of the supporting surface in the path along which the recording target medium is transported.

With this invention, even when a part of the recording target medium on the surface of which an image has now been formed at a position upstream of the supporting surface is raised because of a curl, the recording target medium goes away from the image fixation section quickly as it goes down the slope of the distance-increasing inclined surface, the angle of inclination of which is greater than that of the distance-decreasing inclined surface. Thus, it is possible to avoid the contact of the recording target medium and the image fixation section effectively.

A recording apparatus according to an aspect of the invention includes: a recording section that records an image on a recording target medium; and the image fixation apparatus having the structure described above. With this invention, it is possible to obtain the same operational effects as those of the image fixation apparatus described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
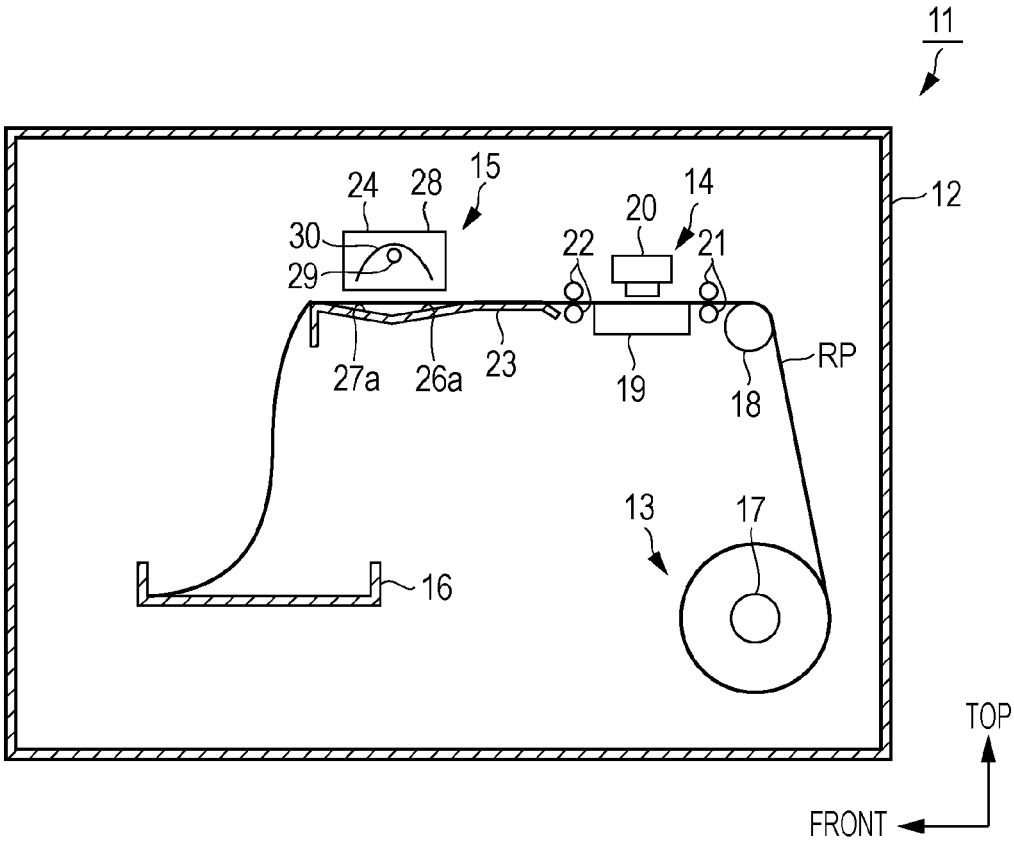
FIG. 1 is a schematic sectional view of an ink-jet printer that is shown as an exemplary embodiment of the invention.

With reference to the accompanying drawings, a recording apparatus according to an exemplary embodiment of the invention will now be explained. An ink-jet printer is taken as an example of the recording apparatus. As illustrated in FIG. 1, an ink-jet printer 11, which is an example of the recording apparatus, includes a body case 12. The body case 12 has the shape of a substantially rectangular parallelepiped. The body case 12, which looks like a box, constitutes an outer-casing part of the ink-jet printer 11. An unreeling unit 13 and a recording unit 14 are provided inside the body case 12. The unreeling unit 13 reels out an elongated roll sheet (continuous form paper) RP. The roll paper RP is an example of a recording target medium. The recording unit 14 performs recording processing to form an image on the roll paper RP unreeled from the unreeling unit 13.

In addition, a heat dryer unit 15 and a paper-eject tray 16 are provided inside the body case 12. The heat dryer unit 15, which is an example of image fixation device, performs heat-dry processing, which is an example of image fixation processing. The image fixation processing is processing of fixing an image on the roll paper RP after the recording of the image on the roll paper RP by the recording unit 14. After the heat-dry processing at the heat dryer unit 15, the roll paper RP is laid in the form of a meandering continuous sheet with multiple turnovers on the paper-eject tray 16.

More specifically, the unreeling unit 13 is located inside the body case 12 near the rear of the body case 12, that is, at the upstream side of the path along which the roll paper RP is transported. The paper-eject tray 16 is located inside the body case 12 near the front of the body case 12, that is, at the downstream side of the path along which the roll paper RP is transported. The recording unit 14 and the heat dryer unit 15 are provided at respective positions between the unreeling unit 13 and the paper-eject tray 16 over the path along which the roll paper RP is transported.

As illustrated in FIG. 1, the unreeling unit 13 is provided with a rotary shaft 17. The rotary shaft 17 extends in the horizontal direction (i.e., the left-right direction, which is perpendicular to the sheet face of FIG. 1) in a rotatable manner. The rotary shaft 17 supports the paper RP in the form of a roll. The roll paper RP can be rotated together with the rotary shaft 17. When the rotary shaft 17 turns in the counterclockwise direction in FIG. 1, the roll paper RP is fed toward the downstream side of the transportation path while being unreeled.

A relay roller 18, which extends in the left-right direction in a rotatable manner, is provided over the unreeling unit 13. The relay roller 18 directs the roll paper RP reeled out from the rotary shaft 17 toward the recording unit 14. The roll paper RP reeled out from the rotary shaft 17 is stretched between the rear of the relay roller 18 and the surface of the roll and is in contact with a part of the roller surface of the relay roller 18 downstream of the stretched part so that the direction of the transportation of the roll paper RP will be changed at the relay roller 18 from the upward direction to the rear-to-front direction.

The recording unit 14 includes a supporting table 19 and a recording head 20. The supporting table 19 supports the back of the roll paper RP that comes from the upstream side from thereunder. The recording head 20, which is an example of a recording section, is provided opposite the supporting table 19. The supporting table 19 and the recording head 20 face each other. The roll paper RP is fed to a gap between the supporting table 19 and the recording head 20. On the path along which the roll paper RP is transported, a pair of paper-feed rollers 21, which feeds the roll paper RP coming from the relay roller 18 onto the supporting table 19 while pinching the roll paper RP, is provided between the relay roller 18 and the recording unit 14. A pair of paper-eject rollers 22 is provided downstream of the recording unit 14 on the path along which the roll paper RP is transported. The paper-eject rollers 22 direct the roll paper RP from the supporting table 19 to the downstream side.

The lower surface of the recording head 20 is formed as a flat nozzle surface through which a plurality of nozzles (not shown) is formed. Ink, which is an example of liquid, is ejected through these nozzles. The recording head 20 ejects ink from each of the nozzles (not shown) onto the roll paper RP that is transported over the supporting table 19 to form an image on the surface of the roll paper RP. The heat dryer unit 15 is provided downstream of the pair of paper-eject rollers 22 on the path along which the roll paper RP is transported.

Figure 2:
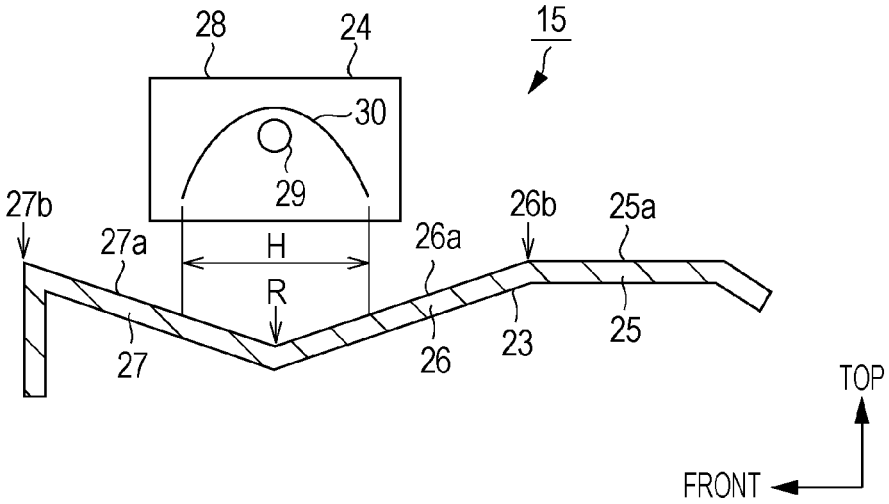
FIG. 2 is a schematic enlarged sectional view of a heat dryer unit of the printer.

Next, the structure of the heat dryer unit 15 will now be explained in detail. As illustrated in FIGS. 1 and 2, the heat dryer unit 15 includes a transportation path plate 23 and a heater unit 24. The transportation path plate 23 is a part of the path along which the roll paper RP is transported. The transportation path plate 23 supports the back of the roll paper RP from thereunder. The heater unit 24 is provided opposite the transportation path plate 23 with the roll paper RP being transported therebetween. The heater unit 24, which is an example of an image fixation section, applies heat to the roll paper RP after the image-recording operation to dry it.

The transportation path plate 23 includes a flat level portion 25, a first inclined portion 26, and a second inclined portion 27. The first inclined portion 26 slopes down from the front end of the level portion 25 toward the front. The second inclined portion 27 slopes up from the front end of the first inclined portion 26 toward the front. The first inclined portion 26 and the second inclined portion 27 are plane-symmetrical to each other in the front-rear direction with respect to a vertical plane including the boundary between the first inclined portion 26 and the second inclined portion 27. Therefore, the first inclined portion 26 and the second inclined portion 27 are formed as a recess, which is recessed from the level portion 25 in the shape of a letter V as viewed in the left-right direction.

The upper surface of the first inclined portion 26 is formed as a distance-increasing inclined surface 26*a*. The distance-increasing inclined surface 26*a* slopes in such a way as to go away from the surface plane of the heater unit 24 so that the distance measured from the surface plane of the heater unit 24 in the top-bottom direction will increase gradually toward the downstream side of the path along which the roll paper RP is transported. On the other hand, the upper surface of the second inclined portion 27 is formed as a distance-decreasing inclined surface 27*a*. The distance-decreasing inclined surface 27*a* slopes in such a way as to come closer to the surface plane of the heater unit 24 so that the distance measured from the surface plane of the heater unit 24 in the top-bottom direction will decrease gradually toward the downstream side of the path along which the roll paper RP is transported.

Therefore, the distance-increasing inclined surface 26*a* and the distance-decreasing inclined surface 27*a* are continuous in the front-rear direction and are located adjacent to each other in this direction. In the present embodiment of the invention, the distance-increasing inclined surface 26*a* and the distance-decreasing inclined surface 27*a* make up a supporting surface that can support the roll paper RP that is being transported. The upper surface of the level portion 25 is formed as a flat surface 25*a*. The flat surface 25*a* is a part of a paper transportation path immediately upstream of the supporting surface (the "going-away" distance-increasing inclined surface 26*a* and the "approaching" distance-decreasing inclined surface 27*a*).

Therefore, the supporting surface (the distance-increasing inclined surface 26*a* and the distance-decreasing inclined surface 27*a*) is relatively distant from the heater unit 24 when measured in the top-bottom direction as compared with the flat surface 25*a*. The flat surface 25*a* is included in a level plane that includes the upper surface of the supporting table 19.

The heater unit 24 is provided across the boundary between the distance-increasing inclined surface 26*a* and the distance-decreasing inclined surface 27*a* as viewed in the front-rear direction. In other words, the heater unit 24 is provided opposite both the distance-increasing inclined surface 26*a* and the distance-decreasing inclined surface 27*a* as viewed in the top-bottom direction. Therefore, in the present embodiment of the invention, the top-bottom direction is the same as the direction in which the heater unit 24 and the supporting surface (the distance-increasing inclined surface 26*a* and the distance-decreasing inclined surface 27*a*) face each other.

The heater unit 24 includes a heater case 28, a heater 29, and a reflector plate 30. The heater case 28 has the shape of an open-bottomed-box-like rectangular parallelepiped. The heater 29 is installed inside the heater case 28. The heater 29 is elongated in the left-right direction. The reflector plate 30 is also installed inside the heater case 28. The reflector plate 30 reflects heat given off by the heater 29 downward. The width of the heater case 28 as viewed in the front-rear direction is set to be smaller than the value of the distance between the upstream end 26*b* of the distance-increasing inclined surface 26*a* and the downstream end 27*b* of the distance-decreasing inclined surface 27*a*.

The heater 29 is located at the center inside the heater case 28 as viewed in the front-rear direction. The reflector plate 30 is located between the ceiling wall of the heater case 28 and the heater 29. When viewed in the left-right direction, the reflector plate 30 has the shape of an inverted letter U, which is turned upside down, so as to cover and enclose the top, front, and rear of the heater 29.

That is, the reflector plate 30 is open at its bottom-edge space, at its left-side space, and at its right-side space. The reflector plate 30 reflects heat given off by the heater 29 toward the roll paper RP that is being transported over the supporting surface (the distance-increasing inclined surface 26*a* and the distance-decreasing inclined surface 27*a*) almost uniformly at a heat-dry area H, which is an area located between the front edge of the reflector plate 30 and the rear edge thereof.

The distance from the surface plane of the heater unit 24 to the upstream end 26*b* of the distance-increasing inclined surface 26*a* in the top-bottom direction is equal to the distance from the surface plane of the heater unit 24 to the downstream end 27*b* of the distance-decreasing inclined surface 27*a* in the top-bottom direction. In other words, the upstream end 26*b* of the distance-increasing inclined surface 26*a* is level with the downstream end 27*b* of the distance-decreasing inclined surface 27*a*.

The boundary R between the distance-increasing inclined surface 26*a* and the distance-decreasing inclined surface 27*a*, that is, the bottom of the valley at which the distance-decreasing inclined surface 27*a* is continuous from the distance-increasing inclined surface 26*a*, corresponds to the center of the heater unit 24 as viewed in the direction from the rear to the front, that is, the direction in which the roll paper RP is transported over the distance-increasing inclined surface 26*a* and the distance-decreasing inclined surface 27*a*. In other words, the junction R where these continuous surfaces meet is located at the center of the heat-dry area H as viewed in the front-rear direction.

Next, the operation of the ink-jet printer 11 will now be explained. When the rotary shaft 17 turns, the roll paper RP is fed toward the downstream side of the transportation path while being unreeled. The unreeling occurs sequentially from the leading edge of the roll paper RP. Having been reeled out therefrom, the roll paper RP moves along the transportation path to pass over the supporting table 19. In the process of passing over the supporting table 19, ink is ejected from the recording head 20 onto the roll paper RP. An image is formed on the roll paper RP in this way. The roll paper RP continues being transported along the transportation path to the downstream side. After the image recording, the leading edge of the roll paper RP arrives at the heat dryer unit 15, which is located at the downstream side.

Figure 3:
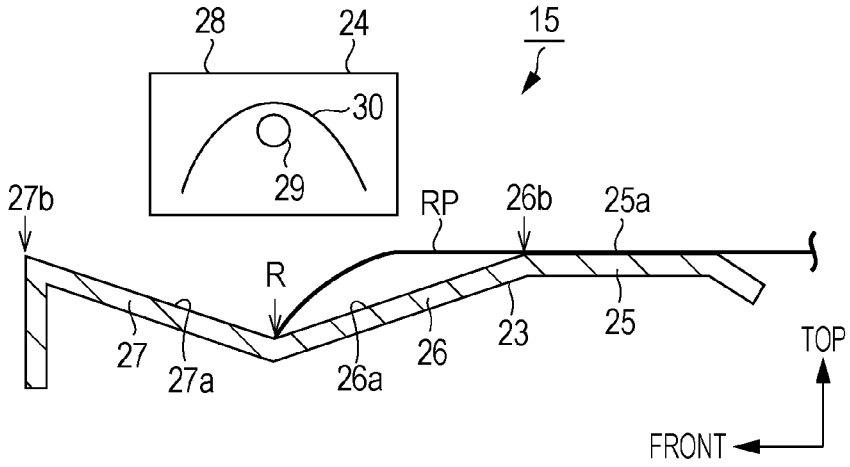
FIG. 3 is a schematic enlarged sectional view illustrating a state in which the curled leading-edge part of roll paper is being transported over a distance-increasing inclined surface in the heat dryer unit.

As illustrated in FIG. 3, at the heat dryer unit 15, the leading edge of the roll paper RP moves over the flat surface 25*a* and goes down the slope of the distance-increasing inclined surface 26*a*. Because of a strong restorative force that acts in the direction of returning into the original form, that is, a roll on the rotary shaft 17, the roll paper RP tends to curl. Therefore, the leading-edge part of the roll paper RP is in an "upward-convex" curled (curved) state. However, the leading-edge part of the roll paper RP goes away from the heater unit 24 as it goes down the slope of the distance-increasing inclined surface 26*a* to the downstream side. By this means, it is possible to prevent the curled leading-edge part of the roll paper RP from contacting with the heater unit 24.

Figure 4:
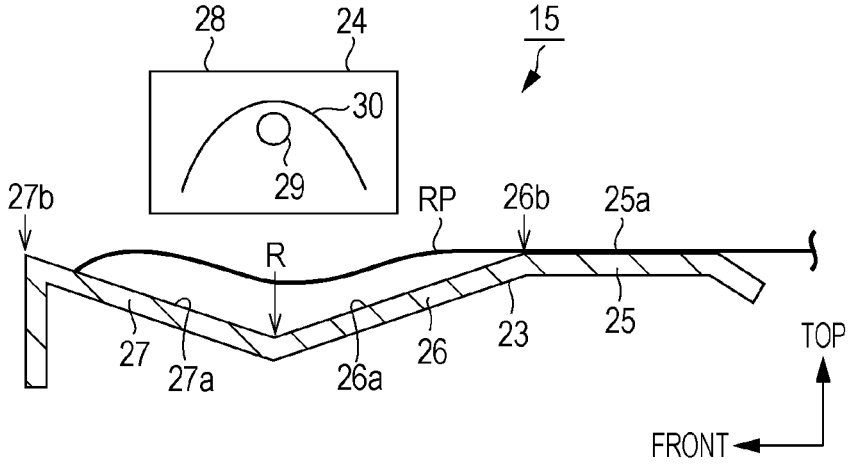
FIG. 4 is a schematic enlarged sectional view illustrating a state in which the curled leading-edge part of the roll paper is being transported over a distance-decreasing inclined surface in the heat dryer unit.

As illustrated in FIG. 4, the curled leading-edge part of the roll paper RP moves from the distance-increasing inclined surface 26*a* to the distance-decreasing inclined surface 27*a*. When the curled leading-edge part of the roll paper RP goes up the slope of the distance-decreasing inclined surface 27*a* to the downstream side, it becomes less curled due to its own weight. For this reason, the curled leading-edge part of the roll paper RP becomes more parallel to the heater unit 24 (which is a relatively flat state) than before it goes up this slope.

Therefore, in the process of moving to the downstream side over the distance-increasing inclined surface 26*a* and the distance-decreasing inclined surface 27*a*, the curled leading-edge part of the roll paper RP is almost uniformly exposed to heat given off by the heater unit 24. As a result of this almost uniform exposure to the heat, the image on the roll paper RP is heat-dried almost uniformly. Therefore, it is possible to fix the image on the roll paper RP with high precision.

As the roll paper RP continues being transported, its curled leading edge runs over the downstream end 27*b* of the distance-decreasing inclined surface 27*a*. Due to gravity, the direction of transportation changes from "from-rear-to-front" to "from-top-to-bottom". Then, the leading-edge part of the roll paper RP arrives at the paper-eject tray 16. The horizontal part of the roll paper RP over the distance-increasing inclined surface 26*a* and the distance-decreasing inclined surface 27*a* is thereafter pulled to the downstream side due to the weight of its vertical part, which is located downstream of the downstream end 27*b* of the distance-decreasing inclined surface 27*a*.

Figure 5:
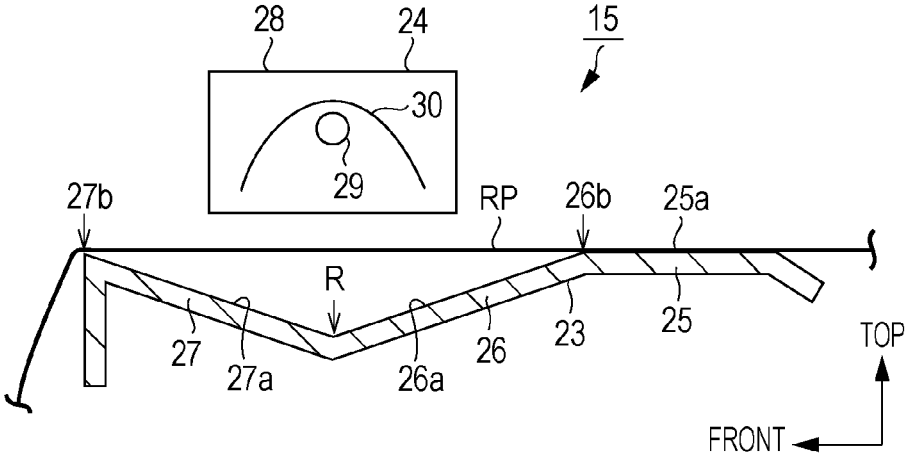
FIG. 5 is a schematic enlarged sectional view illustrating a state in which the curled leading-edge part of the roll paper is being transported to the downstream side beyond the distance-decreasing inclined surface in the heat dryer unit.

Therefore, as illustrated in FIG. 5, the horizontal part of the roll paper RP over the distance-increasing inclined surface 26*a* and the distance-decreasing inclined surface 27*a* is stretched taut while being supported at two places, that is, the upstream end 26*b* of the distance-increasing inclined surface 26*a* and the downstream end 27*b* of the distance-decreasing inclined surface 27*a*. For this reason, the part of the roll paper RP over the distance-increasing inclined surface 26*a* and the distance-decreasing inclined surface 27*a* is transported to the downstream side while being kept parallel to the surface plane of the heater unit 24.

This stabilizes the area of contact of the roll paper RP and the transportation path plate 23, which makes temperature on the roll paper RP stable. Therefore, since heat is applied uniformly to the roll paper RP, on the surface of which the image has been formed by the recording head 20, over the distance-increasing inclined surface 26*a* and the distance-decreasing inclined surface 27*a* to dry it uniformly, it is possible to fix the image on the roll paper RP with high precision. Thus, the quality of printing on the roll paper RP is stable.

After the heat-dry processing at the heat dryer unit 15, the roll paper RP is laid in the form of a meandering continuous sheet with multiple turnovers on the paper-eject tray 16. With the exemplary embodiment described above in detail, it is possible to produce the following effects.

(1) The supporting surface (the distance-increasing inclined surface 26*a* and the distance-decreasing inclined surface 27*a*) is relatively distant from the heater unit 24 when measured in the top-bottom direction as compared with the flat surface 25*a*. Therefore, even when the leading-edge part of the roll paper RP, on the surface of which an image has now been formed at a position upstream of the supporting surface, is raised because of a curl, it is possible to offset this rise of the curled part of the roll paper RP by utilizing the difference between the distance from the heater unit 24 to the flat surface 25*a* and the distance from the heater unit 24 to the supporting surface. Thus, even when the leading-edge part of the roll paper RP is raised because of a curl, it is possible to easily prevent the contact of the roll paper RP and the heater unit 24 with a simple structure, that is, with the forming of the supporting surface at a position that is relatively distant from the heater unit 24 as compared with the flat surface 25*a*.

(2) The supporting surface includes the distance-increasing inclined surface 26*a*, which slopes in such a way as to go away from the surface plane of the heater unit 24 so that the distance measured from the surface plane of the heater unit 24 in the top-bottom direction will increase gradually toward the downstream side of the path along which the roll paper RP is transported. Therefore, even when the leading-edge part of the roll paper RP, on the surface of which an image has now been formed at a position upstream of the supporting surface, is raised because of a curl, it is possible to gradually increase the distance from the heater unit 24 as the curl-raised part near the leading edge of the roll paper RP goes down the slope of the distance-increasing inclined surface 26*a*. Thus, it is possible to smoothly transport the curl-raised part near the leading edge of the roll paper RP to the downstream side along the supporting surface without any contact with the heater unit 24.

(3) The supporting surface includes the distance-decreasing inclined surface 27*a*, which slopes in such a way as to come closer to the surface plane of the heater unit 24 so that the distance measured from the surface plane of the heater unit 24 in the top-bottom direction will decrease gradually toward the downstream side of the path along which the roll paper RP is transported. The distance-decreasing inclined surface 27*a* is located downstream of the distance-increasing inclined surface 26*a* in the path along which the roll paper RP is transported. Therefore, when the curled leading-edge part of the roll paper RP is transported over the supporting surface, even though it becomes inclined with respect to the surface plane of the heater unit 24 at the distance-increasing inclined surface 26*a*, it is possible to make the angle of the inclination of the curled leading-edge part of the roll paper RP smaller at the distance-decreasing inclined surface 27*a*. By this means, it is possible to avoid the lack of uniformity in heat applied for drying to the curled leading-edge part of the roll paper RP by the heater unit 24.

(4) The junction R, which is where the downstream end of the distance-increasing inclined surface 26*a* and the upstream end of the distance-decreasing inclined surface 27*a* are formed, corresponds to the center of the heater unit 24 as viewed in the direction from the rear to the front, that is, the direction in which the roll paper RP is transported. The structure described above makes it possible to balance the distance between the heater unit 24 and the curl-raised part near the leading edge of the roll paper RP well. Because of such a good balance, it is possible to effectively prevent the contact of the curl-raised part near the leading edge of the roll paper RP and the heater unit 24.

(5) The distance from the surface plane of the heater unit 24 to the upstream end 26*b* of the distance-increasing inclined surface 26*a* in the top-bottom direction is equal to the distance from the surface plane of the heater unit 24 to the downstream end 27*b* of the distance-decreasing inclined surface 27*a* in the top-bottom direction. Therefore, after the passing of the curl-raised part near the leading edge of the roll paper RP over the supporting surface (the distance-increasing inclined surface 26*a* and the distance-decreasing inclined surface 27*a*), the roll paper RP is stretched taut in parallel to the surface plane of the heater unit 24 while being supported at two places, that is, the upstream end 26*b* of the distance-increasing inclined surface 26*a* and the downstream end 27*b* of the distance-decreasing inclined surface 27*a*. Thus, it is possible for the heater unit 24 to apply heat to the roll paper RP uniformly, thereby drying it uniformly.

(Variation Examples)

The foregoing exemplary embodiment of the invention may be modified as follows.

Figure 6:
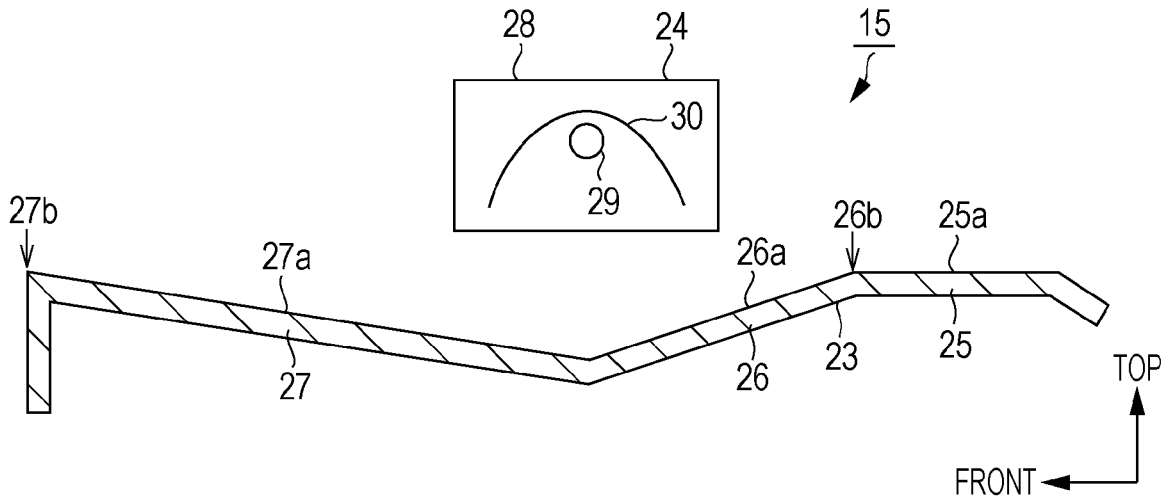
FIG. 6 is a schematic enlarged sectional view illustrating a heat dryer unit according to a variation example.

As illustrated in FIG. 6, in the heat dryer unit 15, the angle of inclination of the distance-increasing inclined surface 26*a* with respect to the flat surface 25*a*, which is a level surface, may be greater than the angle of inclination of the distance-decreasing inclined surface 27*a* with respect to the flat surface 25*a*. In such a modified structure, assuming that the distance from the surface plane of the heater unit 24 to the upstream end 26*b* of the distance-increasing inclined surface 26*a* in the top-bottom direction is equal to the distance from the surface plane of the heater unit 24 to the downstream end 27*b* of the distance-decreasing inclined surface 27*a* in the top-bottom direction, the length of the distance-decreasing inclined surface 27*a* in the left-right direction is greater than the length of the distance-increasing inclined surface 26*a* in the left-right direction. With such a modified structure, when the curl-raised part near the leading edge of the roll paper RP moves to the downstream side along the distance-increasing inclined surface 26*a*, the angle of inclination of which with respect to the flat surface 25*a* is greater than the angle of inclination of the distance-decreasing inclined surface 27*a* with respect to the flat surface 25*a*, this leading-edge part goes away from the surface plane of the heater unit 24 quickly. Thus, it is possible to effectively avoid the contact of the curl-raised part near the leading edge of the roll paper RP and the heater unit 24.

Figure 7:
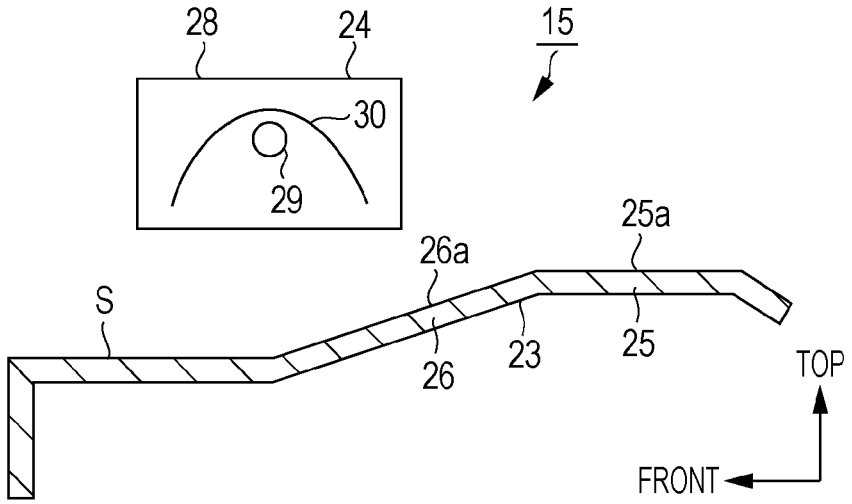
FIG. 7 is a schematic enlarged sectional view illustrating a heat dryer unit according to a variation example.

As illustrated in FIG. 7, in the heat dryer unit 15, the distance-decreasing inclined surface 27*a* may be replaced with a level surface S.

Figure 8:
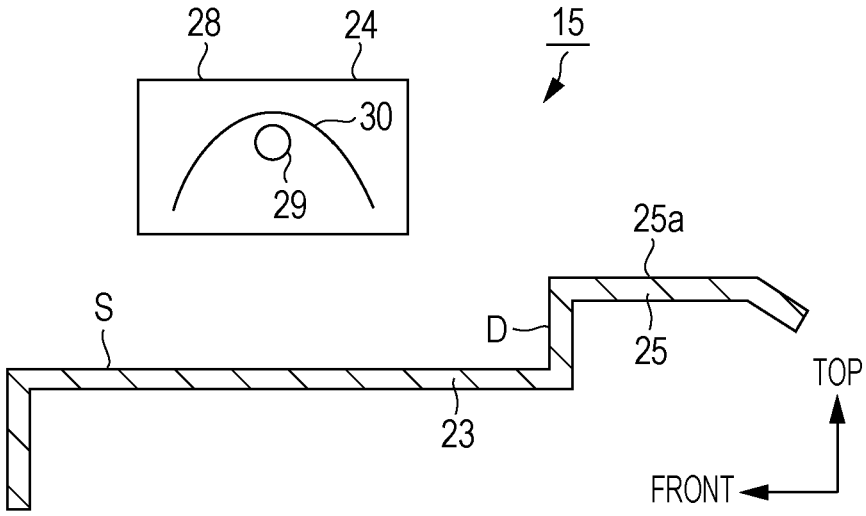
FIG. 8 is a schematic enlarged sectional view illustrating a heat dryer unit according to a variation example.

The structure of the heat dryer unit 15 may be modified as illustrated in FIG. 8 by replacing the supporting surface (the distance-increasing inclined surface 26*a* and the distance-decreasing inclined surface 27*a*) with a level surface S and by setting a level difference D between the level surface S and the flat surface 25*a* in such a way as to make the level surface S lower than the flat surface 25*a*.

Figure 9:
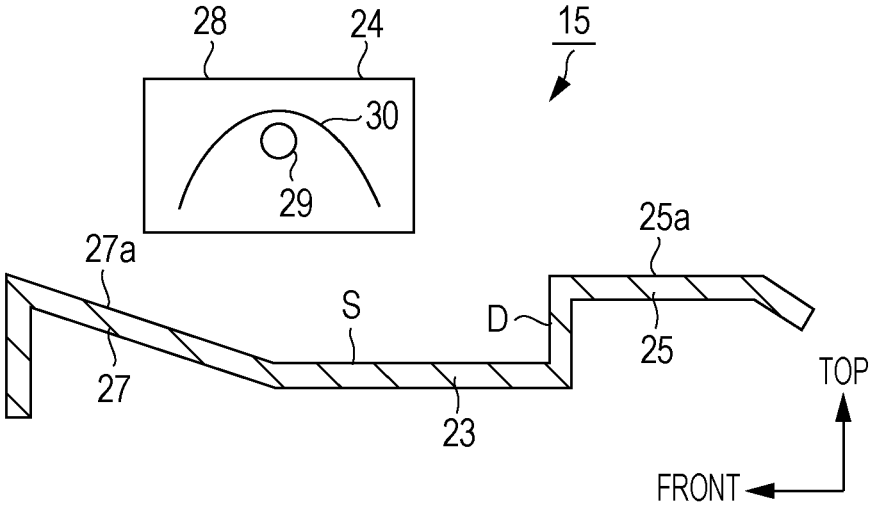
FIG. 9 is a schematic enlarged sectional view illustrating a heat dryer unit according to a variation example.

The structure of the heat dryer unit 15 may be modified as illustrated in FIG. 9 by replacing the distance-increasing inclined surface 26*a* with a level surface S and by setting a level difference D between the level surface S and the flat surface 25*a* in such a way as to make the level surface S lower than the flat surface 25*a*.

Figure 10:
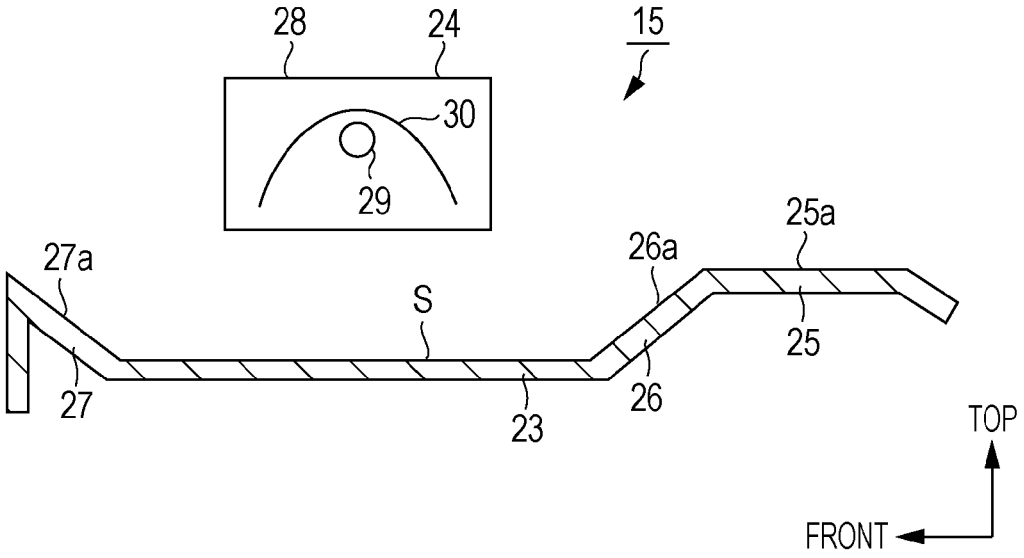
FIG. 10 is a schematic enlarged sectional view illustrating a heat dryer unit according to a variation example.

As illustrated in FIG. 10, in the heat dryer unit 15, a level surface S may be formed between the downstream end of the distance-increasing inclined surface 26*a* and the upstream end of the distance-decreasing inclined surface 27*a*. In such a modified structure, the level surface S and the surface of the heater unit 24 face each other in the top-bottom direction.

Figure 11:
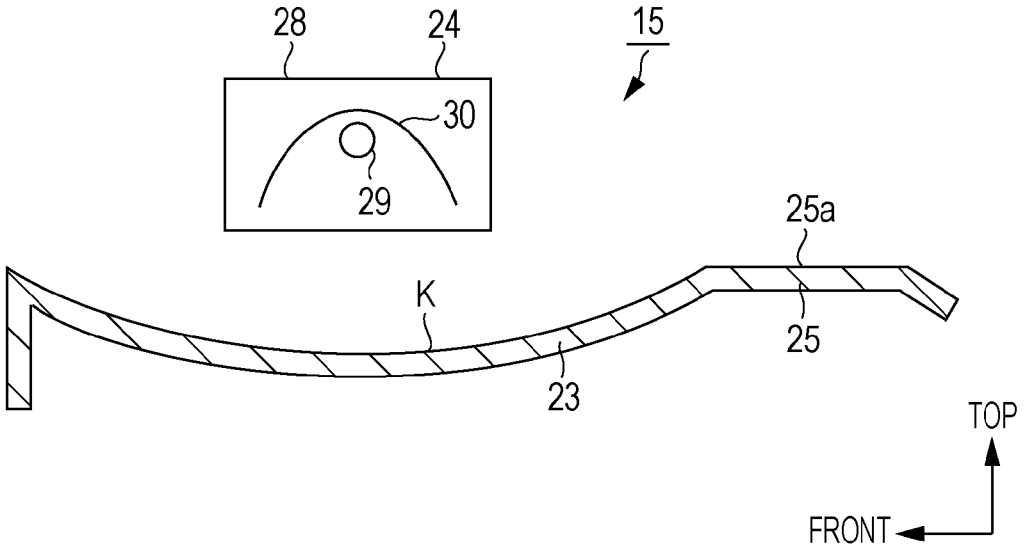
FIG. 11 is a schematic enlarged sectional view illustrating a heat dryer unit according to a variation example.

As illustrated in FIG. 11, in the heat dryer unit 15, the supporting surface (the distance-increasing inclined surface 26*a* and the distance-decreasing inclined surface 27*a*) may be replaced with a curved surface K, which is curved in the shape of a downward-convex arc as viewed in the left-right direction.

In the heat dryer unit 15, it is not always necessary that the distance from the surface plane of the heater unit 24 to the upstream end 26*b* of the distance-increasing inclined surface 26*a* in the top-bottom direction is equal to the distance from the surface plane of the heater unit 24 to the downstream end 27*b* of the distance-decreasing inclined surface 27*a* in the top-bottom direction.

In the heat dryer unit 15, it is not always necessary that the junction R, which is where the downstream end of the distance-increasing inclined surface 26*a* and the upstream end of the distance-decreasing inclined surface 27*a* are formed, corresponds to the center of the heater unit 24 as viewed in the direction from the rear to the front, that is, the direction in which the roll paper RP is transported.

In the heat dryer unit 15, the distance-decreasing inclined surface 27*a* may be omitted.

In the ink-jet printer 11, ultraviolet ray curing ink may be used. In such a modification example, an ultraviolet irradiation device that performs ultraviolet irradiation processing is used as the image fixation device, which performs the image fixation processing of fixing an image on the roll paper RP after the recording of the image on the roll paper RP by the recording unit 14, instead of using the heat dryer unit 15.

A roll of a plastic film, a roll of a metal foil, or the like may be used as the recording target medium as a substitute for the roll paper RP.

Cut sheets (cut-sheet paper) may be used as the recording target medium as a substitute for the roll paper (continuous form paper) RP.

The ink-jet printer 11 is taken as an example of a recording apparatus in the foregoing embodiment of the invention. However, the scope of the invention is not limited thereto. The invention may be applied to a liquid ejecting apparatus that ejects or discharges liquid other than ink. It can be applied to various liquid ejecting apparatuses that are provided with micro-drop liquid ejecting heads for discharging liquid droplets whose amount is very small. Herein, a "liquid droplet" is a state of liquid in the process of ejection of the liquid from a liquid ejecting apparatus. The liquid droplet encompasses, for example, a particulate droplet, a tear-shaped droplet, and a viscous/thready droplet that forms a thread tail, without any limitation thereto. The "liquid" may be made of any material as long as a liquid ejecting apparatus can eject it. The liquid may be any substance as long as it is in a liquid phase. It may have high viscosity or low viscosity. It may be sol or gel water. Or, it may be fluid that includes, without any limitation thereto, inorganic solvent, organic solvent, solution, liquid resin, and liquid metal (e.g., metal melt). The "liquid" is not limited to liquid as a state of a substance. It encompasses a liquid/liquefied matter/material that is made as a result of dissolution, dispersion, or mixture of particles of a functional material made of a solid such as pigment, metal particles, or the like into/with a solvent, though not limited thereto. Typical examples of the liquid are the ink described in the foregoing embodiment and liquid crystal. The term "ink" encompasses various types of ink having various liquid compositions such as popular water-based ink, oil-based ink, gel ink, hot melt ink, or the like. Examples of various liquid ejecting apparatuses are: an apparatus that ejects liquid in which, for example, a material such as an electrode material, a color material, or the like that is used in the production of a liquid crystal display device, an organic EL (electroluminescence) display device, a surface/plane emission display device, a color filter, or the like is dispersed or dissolved, an apparatus that ejects a living organic material that is used for production of biochips, an apparatus that is used as a high precision pipette and ejects liquid as a sample, a textile printing apparatus, a micro dispenser, and the like. In addition, the invention is applicable to a liquid ejecting apparatus that ejects, with high precision, lubricating oil onto a precision instrument and equipment including but not limited to a watch and a camera. Moreover, the invention is applicable to a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention is applicable to a liquid ejecting apparatus that ejects an etchant such as acid or alkali that is used for the etching of a substrate or the like. The invention may be applied to any of these various liquid ejecting apparatuses.

What is claimed is:

1. An image fixation apparatus, comprising:

a supporting surface that is a part of a path along which a recording target medium is transported from an upstream side to a downstream side, the supporting surface being able to support the recording target medium; and an image fixation section that is provided opposite the supporting surface and performs image fixation processing when the recording target medium is supported by the supporting surface after recording of an image on the recording target medium at a position upstream of the supporting surface, the image fixation processing being processing of fixing the image on the recording target medium, wherein, when measured in a direction in which the supporting surface and the image fixation section are provided opposite to each other, the supporting surface is relatively distant from the image fixation section as compared with a region that is located upstream of the supporting surface in the path along which the recording target medium is transported.

2. The image fixation apparatus according to claim 1, wherein the supporting surface includes a distance-increasing inclined surface that slopes in such a way as to go away from the image fixation section so that a distance measured from the image fixation section in the direction in which the supporting surface and the image fixation section are provided opposite to each other will increase gradually toward the downstream side of the path along which the recording target medium is transported.

3. The image fixation apparatus according to claim 2, wherein the supporting surface includes a distance-decreasing inclined surface that slopes in such a way as to come closer to the image fixation section so that a distance measured from the image fixation section in the direction in which the supporting surface and the image fixation section are provided opposite to each other will decrease gradually toward the downstream side of the path along which the recording target medium is transported; and the distance-decreasing inclined surface is located downstream of the distance-increasing inclined surface in the path along which the recording target medium is transported.

4. The image fixation apparatus according to claim 3, wherein the distance-decreasing inclined surface is continuous from the distance-increasing inclined surface at a downstream end of the distance-increasing inclined surface and an upstream end of the distance-decreasing inclined surface; and a junction where the downstream end of the distance-increasing inclined surface and the upstream end of the distance-decreasing inclined surface are formed corresponds to the center of the image fixation section as viewed in a direction in which the recording target medium is transported.

5. The image fixation apparatus according to claim 3, wherein a distance from the image fixation section to the upstream end of the distance-increasing inclined surface in the direction in which the supporting surface and the image fixation section are provided opposite to each other is equal to a distance from the image fixation section to the downstream end of the distance-decreasing inclined surface in the direction in which the supporting surface and the image fixation section are provided opposite to each other.

6. The image fixation apparatus according to claim 3, wherein an angle of inclination of the distance-increasing inclined surface with respect to the region located upstream of the supporting surface in the path along which the recording target medium is transported is greater than an angle of inclination of the distance-decreasing inclined surface with respect to the region located upstream of the supporting surface in the path along which the recording target medium is transported.

7. A recording apparatus, comprising:

a recording section that records an image on a recording target medium; and the image fixation apparatus according to claim 1.

8. The image fixation apparatus according to claim 1, wherein the image fixation section is a heater unit that heats the recording target medium.

* * * * *